US007429024B2

(12) United States Patent
Boklund-Moran

(10) Patent No.: US 7,429,024 B2
(45) Date of Patent: Sep. 30, 2008

(54) HOOK ASSEMBLY, AND KIT

(76) Inventor: Deborah L. Boklund-Moran, 950 C Fairway Cir., Lake Barrington, IL (US) 60010

( * ) Notice: Subject to any disclaimer, the term of this patent is extended or adjusted under 35 U.S.C. 154(b) by 0 days.

(21) Appl. No.: 11/472,972

(22) Filed: Jun. 22, 2006

(65) Prior Publication Data

US 2006/0289714 A1 Dec. 28, 2006

Related U.S. Application Data

(60) Provisional application No. 60/693,103, filed on Jun. 23, 2005.

(51) Int. Cl.
*F16B 45/00* (2006.01)

(52) U.S. Cl. ..... 248/304; 248/306; 248/308; 248/904; 16/429; 16/438

(58) Field of Classification Search ..... 248/304, 248/306, 308, 914, 499, 339; 16/438, 429
See application file for complete search history.

(56) References Cited

U.S. PATENT DOCUMENTS 638,813 A * 12/1899 Ryan ..... 248/294.1
1,260,168 A * 3/1918 Engle ..... 248/290.1
2,154,161 A * 4/1939 Heckman ..... 248/308
2,461,071 A 2/1949 Mettenleiter
3,860,210 A * 1/1975 Berardinelli et al. ..... 248/308
3,861,633 A 1/1975 Rappleye et al.
4,210,302 A * 7/1980 Serkez ..... 248/308
4,312,455 A 1/1982 Weber
6,109,579 A 8/2000 Huang
6,152,419 A * 11/2000 Bender ..... 248/551
7,118,082 B2 * 10/2006 Brnjac ..... 248/308
7,219,686 B2 * 5/2007 Schmitz et al. ..... 137/413
7,234,672 B1 * 6/2007 Osterholt et al. ..... 248/304

* cited by examiner

*Primary Examiner*—Amy J. Sterling
(74) *Attorney, Agent, or Firm*—Meroni & Meroni, P.C.; Charles F. Meroni, Jr.; Christopher J. Scott

(57) ABSTRACT

A hook assembly enables a user to stow handbags and the like underneath tables or similar other support structures. The hook assembly comprises a hook support and a hook member pivotally attached thereto. The hook support comprises an attachment surface and a hook-receiving depression. The hook member is pivotal intermediate a hook-withdrawn position and a hook-extended position. The depression is sized and shaped for housing the hook member when in the hook-withdrawn position. The table-attachment surface may be fixedly attached to the inferior support surface, and the hook actuation end may effectively function to receive and hang articles when the hook member is in the hook-extended position.

4 Claims, 3 Drawing Sheets

HOOK ASSEMBLY, AND KIT

PRIOR HISTORY

This application is a non-provisional patent application claiming priority to provisional U.S. Patent Application No. 60/693,103, filed in the United States Patent and Trademark Office on Jun. 23, 2005.

BACKGROUND OF THE INVENTION

1. Field of the Invention

The present invention generally relates to a hook assembly for hanging articles underneath horizontally disposed support surfaces. More particularly, the present invention relates to a hook assembly and kit for outfitting a table or similar other support structure with a selectively acutable hook assembly for stowing handbags and the like under the table or support structure.

2. Description of Prior Art

An indispensable accessory carried by millions of women is a purse. A purse also known as a pocket book or a handbag, can be manufactured from a variety of materials such as leather, straw, canvas, or silk and is designed to efficiently store a woman's personal belongings. Manufactured in a variety of sizes, colors and styles, all intended to appeal to the individual needs of the consumer, purses are used for everything from carrying an extra tube of lipstick to carrying wallets, cellular telephones, important papers and even extra clothing. Regardless of whether one is clutching a fancy beaded evening bag, a practical and stylish midsize pocket book, or a bulky, oversized tote loaded with enough supplies to last a lifetime, for most women, a purse is the one necessity they will never leave home without.

Although pocket books are an indispensable accessory item for most women, they also present a problem when visiting public places such as restaurants or nightclubs. Frequently, in these types of places there is not enough room at a table or bar to place the handbag and the owner must instead place it on the floor, or on top of the table. Taking up a great deal of valuable space, a purse stored in this manner leaves little room for one's feet, or in the case of table top storage, for one's meal. Another way in which women attempt to store their pocket books when dining out is by hanging them over the back of their chairs. Creating an obstacle course for the server and easily bumped and knocked off the chair by other restaurant patrons, storing purses in this fashion can be a nuisance. Most importantly, purses that are hidden under tables or left dangling from the back of chairs can be inadvertently left behind, or in a worse case scenario, can be easily stolen. As most women can attest, a lost or stolen pocket book can be devastating, as valuable personal belongings such as identification keys, licenses, money and other items are often stored in the confines of a women's purse.

Recognizing the need for a product that would facilitate the easy and convenient storage of purses when dining out, a unique product idea was conceived, developed and is disclosed herein. The so-called Purse Hook of the present invention is a downward projecting hook, configured to be easily mounted to the underside of a table and specifically designed to hold pocket books and other handled items, neatly and efficiently. Manufactured of heavy duty brass material, the Purse Hook would be comprised of a rectangular shaped base plate, on the center of which a heavy duty hanging hook is integrally attached.

This hook would be secured to the base plate by way of a simple hinge mechanism, enabling the user to fold the hook flush against the plate when not in use. The Purse Hook would be easily secured to the underside of a table by way of a sticky glue adhesive which encompasses the bottom of the base plate. Alternately, this device could be permanently mounted to the underside of the table by way of simple threaded screws, packaged and sold with the unit. It is contemplated that the Purse Hook could be marketed and sold directly to restaurants, bars and similar establishments for patron use, or this device could be sold in traditional retail establishments that carry handbags and similar accessories, for direct consumer use.

It is noted that the prior art does disclose various types of purse hooks. In this regard, a few of the more pertinent prior art relating to hook assemblies for use in combination with handbags and the like are briefly described hereinafter. U.S. Pat. No. 2,461,071 ('071 Patent), which issued to Mettenleiter, for example, discloses a Handbag Holder or the Like. The '071 Patent teaches a handbag holding device comprising a section of resilient sheet material bent to form a C clamp having a top and bottom portion adapted to receive a projecting table edge between them, said bottom portion having a portion continuous with the end thereof, said continuous portion bent downwardly and rearwardly with respect to the end of the bottom portion and twisted and bent to form a hook member set at right angles to the C clamp.

U.S. Pat. No. 3,861,633 ('633 Patent), which issued to Rappleye et al., discloses a Grocery Cart Hook. The '633 Patent teaches a hook fastened to a metal plate which is bolted to a side of a grocery cart for retention of a pocketbook of the user of the cart, while shopping. The hook is pivotably mounted so as to swivel in the horizontal plane, when mounted, and is fitted with a torsion spring to fix the hook in a latched position.

U.S. Pat. No. 4,312,455 ('455 Patent), which issued to Weber, discloses a Table Parcel Holder. The '455 Patent teaches a holding device for supporting articles such as handbags, newspapers and packages underneath a table top in a dining area, the device being provided with a pivotal attachment which can be secured to any vertical surface underneath a table or to an under-surface of the table top. The holding device is provided with one or more holding members that are pivotally supported to make the holding members more adaptable for supporting the articles whether the holding device is secured from a vertical or a horizontal table surface. The pivotal attachment may possess a reticulated construction adapted for attachment to an arcuate table surface.

U.S. Pat. No. 6,109,579 ('579 Patent), which issued to Huang, discloses a Hidden Type Hook Device. The '579 Patent teaches a hook device includes a panel having a compartment defined therein. A hook includes a first section pivotally connected to the panel and a second hooked section removably received in the compartment. An elastic member is provided for moving the second hooked section of the hook outside the compartment. A push button is provided for releasably retaining the second hooked section of the hook in the compartment.

The prior art thus perceives a need for a hook assembly having a hook member pivotable about an axis of rotation substantially parallel to a hook-supporting attachment surface, which, when in a hook-withdrawn position is concealed or housed within a hook-receiving depression and which, when in a hook-extended position, functions to hang or stow hangable articles therefrom.

SUMMARY OF THE INVENTION

Accordingly, it is thus an object of the current invention to provide a hook assembly for use in combination with an inferior support surface, such as the underside of a table. The hook assembly of the present invention may be said to summarily comprise a hook support and a hook member. The hook support comprises a superior attachment surface and an inferior hook-receiving depression. The depression comprises a hook access end and a hook pivot end. The hook member comprises a hook actuation end and a hook attachment end.

The hook attachment end is pivotally attached to the hook pivot end, the hook member thereby being pivotal intermediate a hook-withdrawn position and a hook-extended position. The depression is sized and shaped for housing the hook member when in the hook-withdrawn position. The table-attachment surface may be fixedly attached to the inferior support surface, and the hook actuation end may effectively function to receive and hang articles when the hook member is in the hook-extended position.

The purse hook contemplated by the current disclosure is a practical product invention which will enable consumers to store purses, as well as a variety of handled items in an efficient manner. Manufactured of sturdy materials, this compact unit could prove an invaluable tool for the many women and men who enjoy dining out. Affordably priced, the purse hook assembly of the present invention should be well received by the general consumer populace, as well as by professional restaurateurs, a very sizable market potential.

BRIEF DESCRIPTION OF THE DRAWINGS

Other features of my invention will become more evident from a consideration of the following brief description of patent drawings:

FIG. No. 1 is an perspective view of the hook assembly of the present invention with the hook member shown in the hook-withdrawn position.

Figure 1:
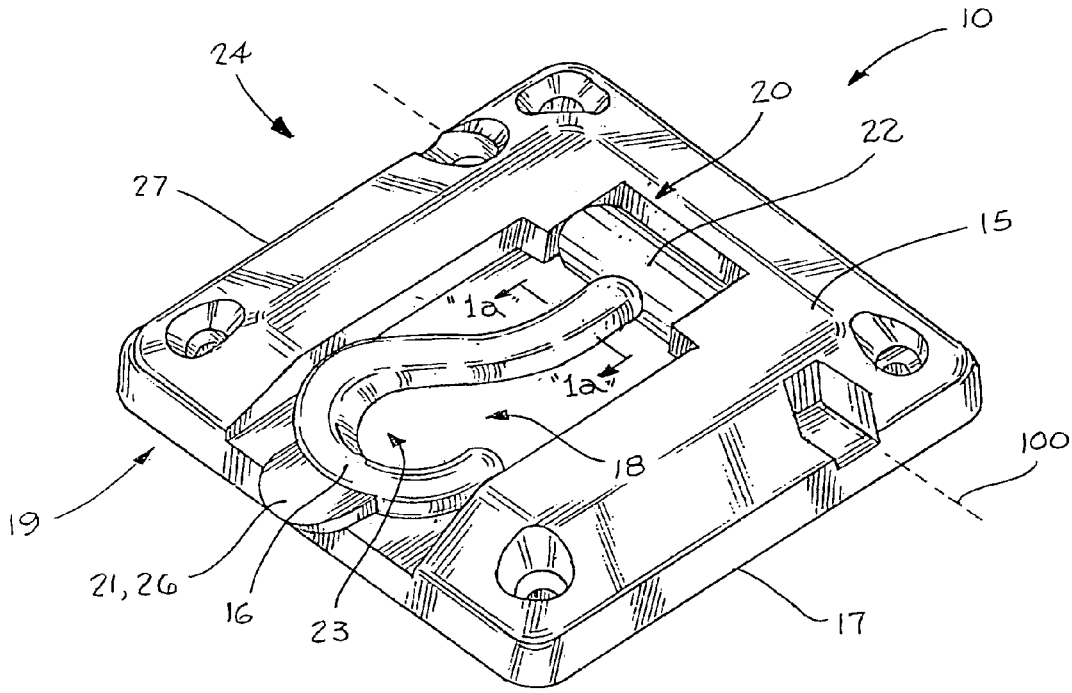
Figure 1A:
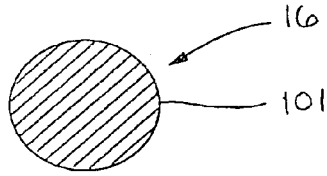
Figure 2:
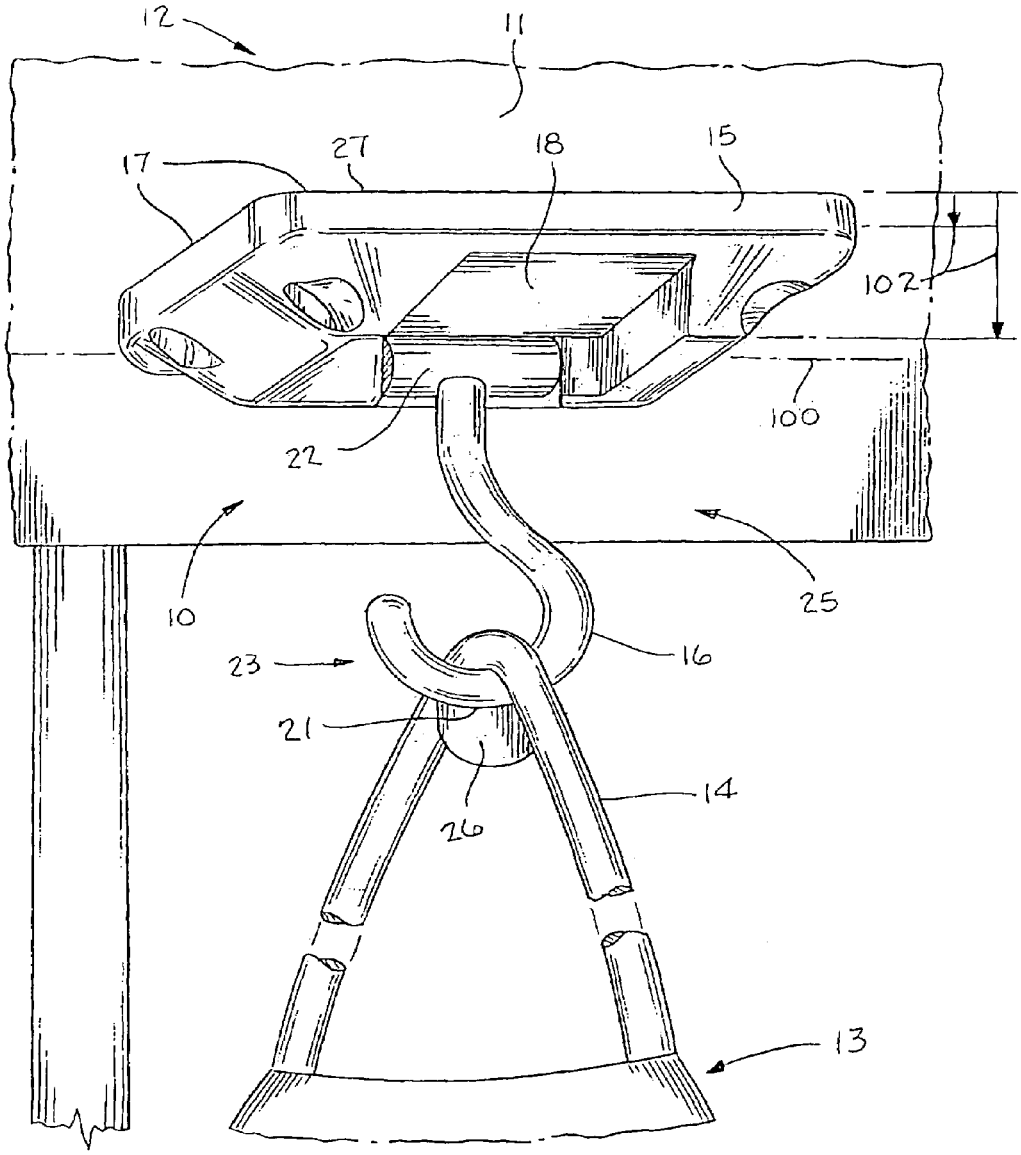
Figure 3:
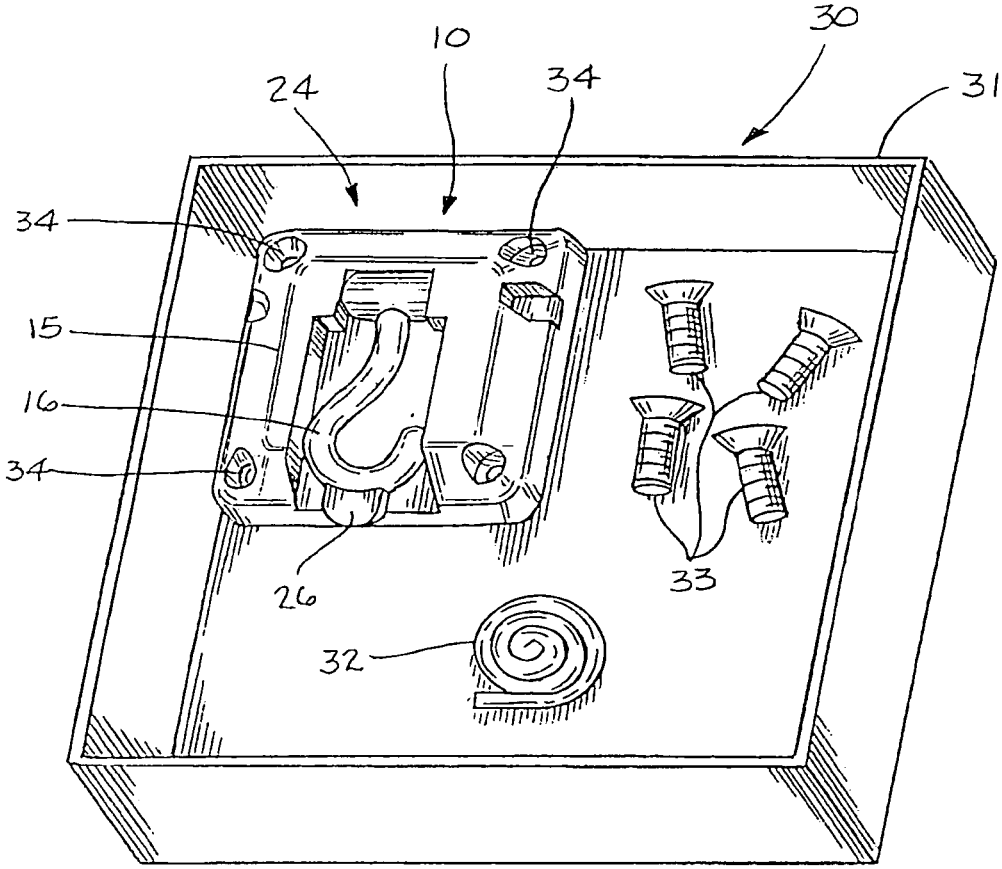

FIG. No. 1(*a*) is a transverse cross-sectional depiction of the hook member.

FIG. No. 2 is a perspective view of the hook assembly of the present invention with the hook member shown in the hook-extended position and further depicting the hook assembly attached to a fragmentary table with a fragmentary handbag hanging therefrom.

FIG. No. 3 is a top perspective view of a hook assembly kit contemplated by the present invention showing the hook assembly, double-sided tape fastening structure, and threaded hardware fastening structure.

DESCRIPTION OF THE PREFERRED EMBODIMENT(S)

Referring now to the drawings, the preferred embodiment of the present invention generally concerns a handbag-hanging system, the handbag-hanging system for hanging a handbag in inferior adjacency to a table support surface. More particularly, the present invention concerns a hook assembly 10 as generally illustrated and referenced in FIG. Nos. 1-3. It is contemplated that hook assembly 10 is usable in combination with an inferior support surface 11 such as may be found on the underside of a table of similar other support structure as generally depicted in FIG. No. 2. It is contemplated that the handbag-hanging system of the present invention may preferably comprise, in combination a table 12 as generally depicted and referenced in fragmentary form in FIG. No. 2; a handbag 13 as generally depicted and referenced in fragmentary form in FIG. No. 2; and hook assembly 10. Hook assembly 10 function to serve as a coupling type structure intermediate table 12 and handbag 13. In this regard, it is contemplated that table 12 essentially comprises inferior support surface 11 and handbag essentially comprises a bag-supporting loop 14 as generally illustrated and referenced in FIG. No. 2.

Hook assembly 10 preferably comprises a hook support 15 as illustrated and referenced in FIG. Nos. 1, 2, and 3; and a hook member 16 as illustrated and referenced in FIG. Nos. 1-3, inclusive. Hook support 15 preferably comprises a planar superior table-attachment surface 17 as referenced in FIG. Nos. 1 and 2; and an inferior hook-receiving depression 18 as generally depicted and referenced in FIG. Nos. 1 and 2. The depression essentially comprises a hook access end 19 and a hook pivot end 20 as generally referenced in FIG. No. 1. Hook member 16 essentially comprises a hook actuation end 21, a hook attachment end 22, and a hook bend 23 all as illustrated and referenced in FIG. Nos. 1 and 2. It should be understood from an inspection of the noted figures that hook bend 23 inherently has at least one, but preferably a substantially uniform radius of curvature.

The hook attachment end 22 is pivotally attached to the hook pivot end 20 as generally and comparatively depicted in FIG. Nos. 1 and 2. Thus, hook member 16 is preferably pivotal intermediate a hook-withdrawn position 24 as generally depicted in FIG. Nos. 1 and 3; and a hook-extended position 25 as generally depicted in FIG. No. 2. It will be understood that the hook member 16 is pivotable about a pivot axis of rotation 100 extending through the hook attachment end 22 as generally depicted in FIG. Nos. 1 and 2. The pivot axis of rotation 100 is preferably parallel to the table-attachment surface 17.

The hook actuation end 21 preferably a hook-actuating tab 26 as illustrated and referenced in FIG. Nos. 1, 2, and 3. From an inspection of FIG. No. 1, it will be seen that the hook actuating tab 26 extends outwardly from the hook access end 19 when in the hook-withdrawn position 24. It is contemplated that the hook-actuating tab 26 may effectively function to enhance a user's ability to manually (i.e. via one's hand and/or fingers) pivot the hook member 16 from the hook-withdrawn position 24 to the hook-extended position 25. In other words, without the use of one's sight (the assembly 10 being affixed to the underside of a table or similar structure), the user may, via tactile sensation, easily maneuver the hook member 16 into the hook-extended position 25 by way of the tab 26.

Preferably, hook-actuating tab 26 is substantially planar, and coplanar with the radius of curvature and the axis of rotation 100 for enhancing a user's ability to manually pivot the hook member 16 intermediate the hook-extended and hook-withdrawn positions 25 and 24. In other words, the tab 26 further functions to enable the user to maneuver the hook member intermediate the positions 24 and 25 by providing planar structure coplanar with the plane in which the hook member 16 primarily lies.

It should be noted from an inspection of the noted figures that depression 18 is preferably sized and shaped for housing or receiving hook member 16 when in the hook-withdrawn position 24. Further, it should be understood from a comparative inspection of the noted figures that the radius of curvature is preferably formed such that it is substantially parallel to the table-attachment surface 11 when in the hook-withdrawn position 24 and substantially orthogonal to the table-attachment surface 11 when in the hook-extended position 25. In other words, the hook member 16 is preferably pivotable through an angle of about 90 rotational degrees, the extreme positions representing the hook-withdrawn and hook-extended positions 24 and 25.

The table-attachment surface 17 may thus be fixedly attached to the inferior support surface 11 via certain assembly-fastening means and the bag-supporting loop 14 is receivable upon the hook member 16 when in the hook-extended position 25. Thus, the handbag-hanging system of the present invention may effectively function to hang the handbag 13 in inferior adjacency to the inferior support surface 11 of the table 12.

It is contemplated that the hook assembly 10 further comprises certain surface profile characteristics that render the assembly more safe when used in combination with a table (under which are typically received a user's legs in addition to conveniently stowed handbags and the like). In this regard, it is contemplated that the hook member 16 may preferably comprises a rounded transverse cross-section as generally depicted in FIG. Nos. 1, 2, and 3 and as specifically depicted in FIG. No. 1(*a*) at 101. In this regard, it is contemplated that the rounded transverse cross-section 101 may effectively function to deflect matter (passing thereby such as clothing, exposed skin, etc.) away from the hook member 16 so as to prevent damage and/or injury to the deflected matter. In other words, sharp edges may well function to otherwise snag and or injure objects passing thereby and in this regard, rounded edges are to be preferred.

In this same vein, it is contemplated that the hook support 15 may preferably comprise a variable depression-flanking (superior surface to inferior surface) thickness as generally depicted at 102 in FIG. Nos. 1, 2, and 3; and a support periphery 27 as referenced in FIG. Nos. 1 and 2. It will be seen from an inspection of the figures that the depression-flanking thickness is preferably maximal adjacent the depression 18 and minimal adjacent the support periphery 27. It is contemplated that the variable depression-flanking thickness 102 may effectively function to deflecting matter away from the depression 18 as heretofore specified. Preferably, the depression-flanking thickness may be pyramidal as uniformly sloped for maximizing hook support structural strength of hook support 15.

Use of the Purse Hook is simple and straight forward. First, the Purse Hook would be easily secured to the underside of a table top, bar, or other flat surface and would be positioned so that the hook-like holder faced outwards, projecting slightly from the edge of the table top, thus ensuring ready access when needed. As mentioned, the top of the base plate could be coated in a sticky glue adhesive, enabling the user to adhere the device directly to the underside of the table, or the Purse Hook could be secured in place via threaded screws. Restaurateurs would install individual Purse Hooks in appropriate positions about the perimeter of the tabletop, making sure to secure a purse hook at each place setting. Upon sitting down at the table, the customer would simply grasp the end of the Purse Hook positioned in front of their seat, pulling it from its position flush against the base plate and extending the unit downward so that the hook hovered directly below and in front of the table top. Next, the under would simply suspend their purse or other handled item from the Purse Hook, conveniently accessing the contents as needed and easily removing the item after use.

It will thus be understood that there are many benefits and advantages associated with the Purse Hook. Foremost, this cleverly designed product would provide efficient storage for a purse. Saving valuable space on the table top as well as below, the Purse Hook could prove a convenient alternative to other methods of storage. Making practical use of available space below a tabletop, use of the Purse Hook would allow more room for the restaurant staff, as well as other patrons, to maneuver around the area. This benefit could prove particularly advantageous on busy weekend nights, afternoon lunch shifts and during advertised specials, when restaurants can be particularly crowded.

Another advantage is that the Purse Hook would store pocket books in an easily visible and readily accessible fashion. In this manner, the possibility of forgetting one's purse, or having it stolen when dining, could be significantly reduced. A convenient method of storing purses, the Purse Hook could also be used to carefully store briefcases, handled umbrellas, shopping bags, diaper bags, hats and keys, with ease. Provided by restaurants and other establishments for patron use, the compact size of the Purse Hook would enable consumers to easily transport the device under a purse of briefcase, making this product ideal for use by general consumers as well. Durably constructed of quality materials, the Purse Hook should withstand repeated use, with ease.

While the above description contains much specificity, this specificity should not be construed as limitations on the scope of the invention, but rather as an exemplification of the invention. For example, it is contemplated that the present invention may be said to effectively teach a hook assembly kit 30 as generally depicted in FIG. No. 3. In this regard, it is contemplated that the hook assembly kit 30 may effectively function to enable a user to outfit the inferior support surface of a table or similar other support structure. The outfitted inferior support surface may thus function to hang articles in inferior adjacency to the inferior support surface. The hook assembly kit may be packaged (as at box 31) and may preferably comprise certain assembly-fastening means and hook assembly 10.

The hook assembly 10 essentially comprises hook support 15 and hook member 16. Hook support 15 essentially comprises a superior attachment surface such as attachment surface 17 and an inferior hook-receiving depression such as depression 18. The depression may essentially comprise a hook access end and a hook pivot end, and the hook member may comprise a hook actuation end and a hook attachment end. The hook attachment end is pivotally attached to the hook pivot end, the hook member thereby being pivotal intermediate a hook-withdrawn position and a hook-extended position. The depression is preferably sized and shaped for housing the hook member when in the hook-withdrawn position. The table-attachment surface is fixedly attachable to the inferior support surface via the assembly-fastening means, as may be defined by certain select fastening structure. The hook actuation end may thus function to receive and hang articles when in the hook-extended position.

It is contemplated that the select fastening structure may be selected from the group consisting of double-sided tape 32 as illustrated in rolled assembly in FIG. No. 3; and certain fastening hardware, such as screws or bolts 33 as further illustrated and referenced in FIG. No. 3. It is contemplated that the double-sided tape 32 may be applied to the superior attachment surface of the hook support for adhesively attaching the superior attachment surface to an inferior support surface. Alternatively, the fastening hardware may be orthogonally extendable through the hook support (as for example, via bore holes 34) for structurally positioning the superior attachment surface in inferior adjacency to the inferior support surface.

Accordingly, although the invention has been described by reference to certain preferred and alternative embodiments, it is not intended that the novel disclosures herein presented be limited thereby, but that modifications thereof are intended to be included as falling within the broad scope and spirit of the foregoing disclosure, the following claims and the appended drawings.

I claim:

1. A hook assembly, the hook assembly for use in combination with an inferior support surface, the hook assembly comprising:

a hook support and a hook member, the hook support comprising a superior attachment surface and an inferior hook-receiving depression, the depression comprising a hook access end and a hook pivot end, the hook member comprising a hook actuation end and a hook attachment end, the hook attachment end being pivotally attached to the hook pivot end, the hook member being pivotal about a pivot axis intermediate a hook-withdrawn position and a hook-extended position, the depression being sized and shaped for housing the hook member when in the hook-withdrawn position, the superior attachment surface being fixedly attachable to the inferior support surface, the hook actuation end comprising a substantially planar, hook-actuating tab, the hook actuating tab being coplanar with the pivot axis and extending outwardly from the hook access end, the hook-actuating tab for enhancing a user's ability to manually pivot the hook member intermediate the hook-extended and hook-withdrawn positions, the hook actuation end for receiving and hanging articles when in the hook-extended position.

2. A hook assembly, the hook assembly for use in combination with an inferior support surface, the hook assembly comprising:

a hook support and a hook member, the hook support comprising a superior attachment surface, an inferior hook-receiving depression, a pyramidally-shaped depression-flanking thickness, and a support periphery, the depression comprising a hook access end and a hook pivot end, the depression-flanking thickness being maximal adjacent the depression and minimal adjacent the support periphery for maximizing hook support strength and deflecting matter away from the depression, the hook member comprising a hook actuation end and a hook attachment end, the hook attachment end being pivotally attached to the hook pivot end, the hook member being pivotal intermediate a hook-withdrawn position and a hook-extended position, the depression being sized and shaped for housing the entire hook member when in the hook-withdrawn position, the superior attachment surface being fixedly attachable to the inferior support surface, the hook actuation end for receiving and hanging articles when in the hook-extended position.

3. A hook assembly kit, the hook assembly kit for outfitting an inferior support surface, the outfitted inferior support surface for hanging articles in inferior adjacency to the inferior support surface, the hook assembly kit comprising:

assembly-fastening means; and a hook assembly, the hook assembly comprising a hook support and a hook member, the hook support comprising a superior attachment surface and an inferior hook-receiving depression, the depression comprising a hook access end and a hook pivot end, the hook member comprising a hook actuation end and a hook attachment end, the hook actuation end comprising a substantially planar, hook-actuating tab, the hook attachment end being pivotally attached to the hook pivot end, the hook member being pivotal about a pivot axis intermediate a hook-withdrawn position and a hook-extended position, the depression being sized and shaped for housing the hook member when in the hook-withdrawn position, the superior attachment surface being fixedly attachable to the inferior support surface via the assembly-fastening means, the hook actuating tab being coplanar with the pivot axis and extending outwardly from the hook access end, the hook-actuating tab for enhancing a user's ability to manually pivot the hook member intermediate the hook-extended and hook-withdrawn positions, the hook actuation end for receiving and hanging articles when in the hook-extended position.

4. A hook assembly kit, the hook assembly kit for outfitting an inferior support surface, the outfitted inferior support surface for hanging articles in inferior adjacency to the inferior support surface, the hook assembly kit comprising:

assembly-fastening means; and a hook assembly, the hook assembly comprising a hook support and a hook member, the hook support comprising a superior attachment surface, an inferior hook-receiving depression, a pyramidally-shaped depression-flanking thickness, and a support periphery, the depression comprising a hook access end and a hook pivot end, the depression-flanking thickness being maximal adjacent the depression and minimal adjacent the support periphery for maximizing hook support strength and deflecting matter away from the depression, the hook member comprising a hook actuation end and a hook attachment end, the hook attachment end being pivotally attached to the hook pivot end, the hook member being pivotal about a pivot axis intermediate a hook-withdrawn position and a hook-extended position, the depression being sized and shaped for housing the entire hook member when in the hook-withdrawn position, the superior attachment surface being fixedly attachable to the inferior support surface via the assembly-fastening means, the hook actuation end for receiving and hanging articles when in the hook-extended position.

* * * * *